US008573515B2

(12) United States Patent
Stednitz

(10) Patent No.: US 8,573,515 B2
(45) Date of Patent: Nov. 5, 2013

(54) AERATING NOZZLE TIP

(75) Inventor: Samuel Gregory Stednitz, St. Clair, PA (US)

(73) Assignee: Strahman Valves, Inc., Bethlehem, PA (US)

( * ) Notice: Subject to any disclaimer, the term of this patent is extended or adjusted under 35 U.S.C. 154(b) by 416 days.

(21) Appl. No.: 12/894,095

(22) Filed: Sep. 29, 2010

(65) Prior Publication Data

US 2011/0079664 A1 Apr. 7, 2011

Related U.S. Application Data

(60) Provisional application No. 61/248,564, filed on Oct. 5, 2009.

(51) Int. Cl.
*B05B 1/14* (2006.01)

(52) U.S. Cl.
USPC ..... 239/554; 239/428.5

(58) Field of Classification Search
USPC ..... 239/554, 553.5, 552, 425.5, 428.5, 344, 239/361
See application file for complete search history.

(56) References Cited

U.S. PATENT DOCUMENTS

| | | | | | |
|---|---|---|---|---|---|
| 1,769,821 | A | | 7/1930 | Barber | |
| 2,603,469 | A | | 7/1952 | Bedford et al. | |
| 2,724,583 | A | * | 11/1955 | Targosh et al. | 239/311 |
| 2,785,926 | A | | 3/1957 | Lataste | |
| 3,646,607 | A | * | 2/1972 | Dower | 261/59 |
| 3,705,821 | A | | 12/1972 | Breer et al. | |
| 3,918,647 | A | | 11/1975 | Lamz et al. | |
| 4,013,227 | A | | 3/1977 | Herrera | |
| 4,072,270 | A | | 2/1978 | Harmony | |
| 4,278,418 | A | | 7/1981 | Strenkert | |
| 4,288,984 | A | * | 9/1981 | Bhat et al. | 60/262 |
| 4,346,844 | A | * | 8/1982 | Harmony | 239/381 |
| 4,426,040 | A | * | 1/1984 | Smith | 239/428.5 |
| 4,969,814 | A | | 11/1990 | Ho et al. | |
| 5,054,688 | A | * | 10/1991 | Grindley | 239/407 |
| 5,111,994 | A | * | 5/1992 | Gonzalez | 239/428.5 |
| 5,542,608 | A | | 8/1996 | Kaylor | |
| 5,779,158 | A | | 7/1998 | Baker | |
| 6,270,022 | B1 | | 8/2001 | Knapp | |
| 6,322,008 | B1 | | 11/2001 | Aker et al. | |
| 7,100,844 | B2 | | 9/2006 | McGuire | |
| 7,219,849 | B1 | | 5/2007 | Hedger | |
| 2004/0026528 | A1 | | 2/2004 | Jenkins | |

* cited by examiner

*Primary Examiner* — Davis Hwu
(74) *Attorney, Agent, or Firm* — Graham Curtin, P.A.

(57) ABSTRACT

An aerating nozzle tip comprises a housing having a central axis, an inlet, an outlet, a plurality of passages disposed around the central axis between the inlet and the outlet, and a circumferential aspirator disposed between the inlet and the outlet.

20 Claims, 4 Drawing Sheets

AERATING NOZZLE TIP

CROSS-REFERENCE TO RELATED APPLICATIONS

This application claims the benefit of U.S. Application 61/248,564, filed on Oct. 5, 2009, which is incorporated herein by reference.

FIELD OF THE INVENTION

The present invention relates to a nozzle generally, and more particularly to an aerating nozzle tip having a plurality of converging outlet openings and a circumferential aspirator.

BACKGROUND

The most effective type of spray nozzle used on wash down equipment will produce a stream of water that, in the food service industry, cleans dishes, pans, pots and the like with the most debris removal in the shortest amount of time. The goal is to rinse well enough so that food and grease does not remain on the dishes when they emerge from a commercial dishwasher. Typically, multiple dishes are arranged on a rack and are pre-rinsed together, while pots and deeper items must be rinsed separately.

A forceful stream of water, such as a jet stream emanating from a nozzle outlet defined by a single generally-circular opening, is likely to remove more food debris than a nozzle outlet that is elongated or curved, such as with a crescent-shaped opening, for example, that might be more suited for clean room applications where it is desired to wash down walls or expansive surfaces. However, a jet stream has a significant disadvantage in certain environments where, for example, the item being washed is a deep container, or has a narrow opening. In these situations, a forceful water jet can result in significant back splash that has the possibility of contaminating the equipment operator and/or the surroundings. In some cases, the wash down equipment is located very close to the food preparation area or the customer service area, whereby the back splash can result in food contamination or soiling of the customer.

There is a need, therefore, to provide a nozzle outlet that cleans effectively while minimizing back splash.

SUMMARY

An aerating nozzle tip comprises a housing having a central axis, an inlet, an outlet, a plurality of passages disposed around the central axis between the inlet and the outlet, and a circumferential aspirator disposed between the inlet and the outlet. In one embodiment, the plurality of passages defines a straight stream utilizing three separate outlet openings that spray in a cone shape and converge at a distance from the outlet, such as nine inches from the outlet, for example. A valuable advantage of this nozzle embodiment is the minimizing of back splash due to the aspirator which draws air into the flow to soften water impact with hard surfaces while at the same time producing a very effective spray rinse.

DETAILED DESCRIPTION OF THE PREFERRED EMBODIMENTS

Figure 1:
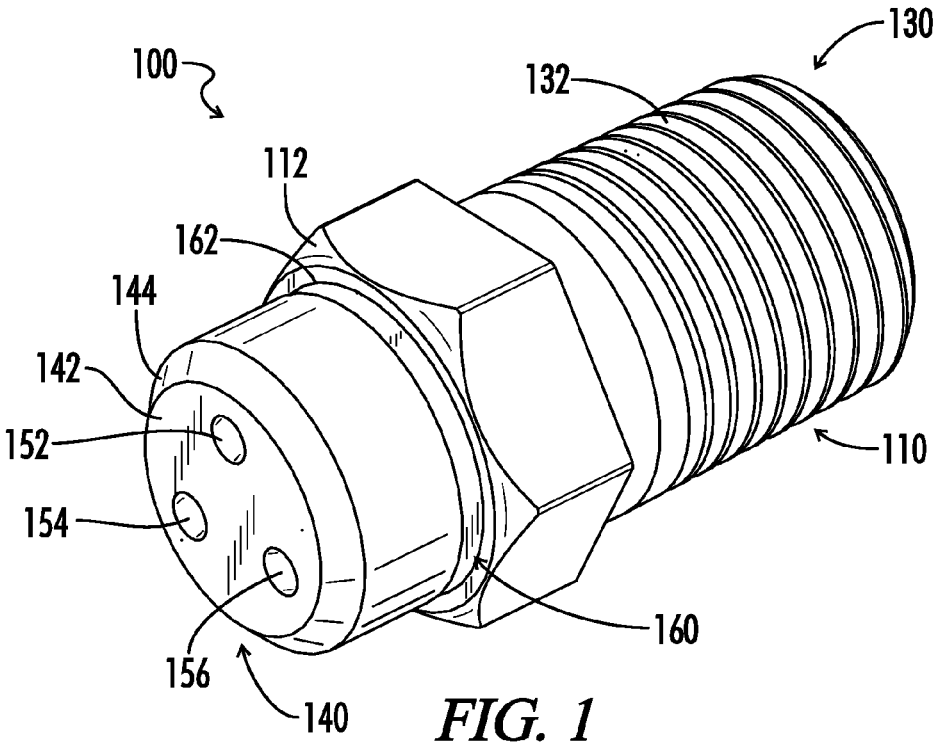
FIG. 1 is a perspective view of one embodiment of a nozzle tip of the present disclosure.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts, and the dimensions and tolerances are shown for purposes of illustration and are not included or intended to limit the scope of the disclosure.

Figure 2:
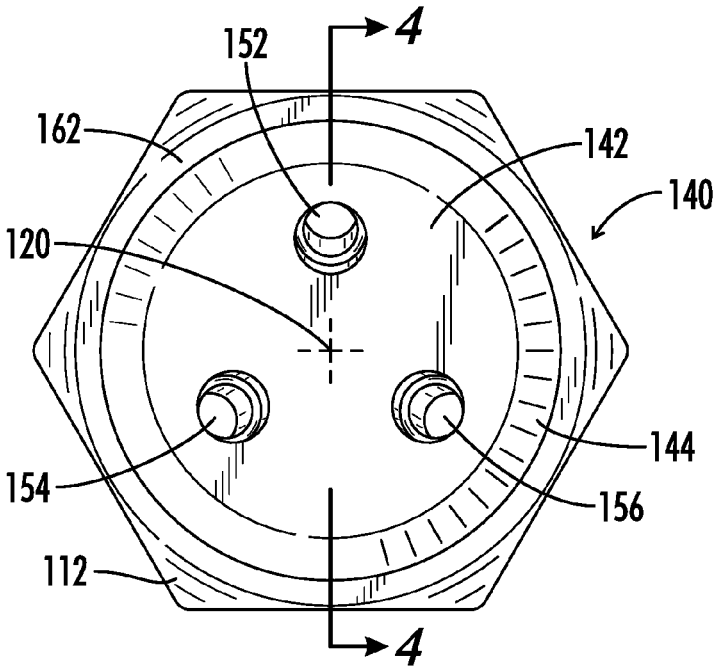
FIG. 2 is a front view of the nozzle tip of FIG. 1.
Figure 3:
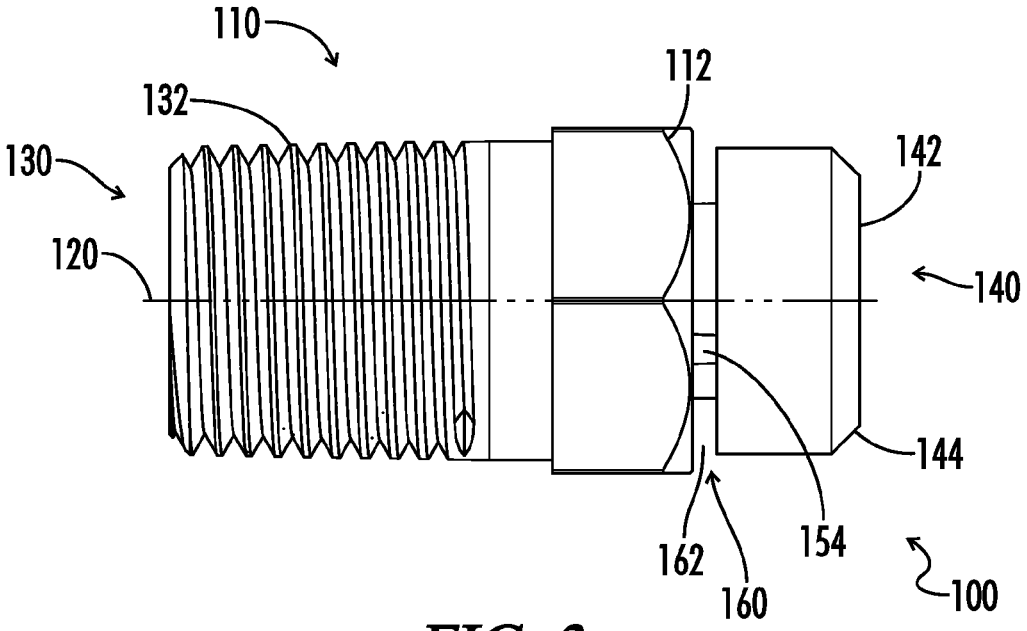
FIG. 3 is a side view of the nozzle tip of FIG. 1.
Figure 4:
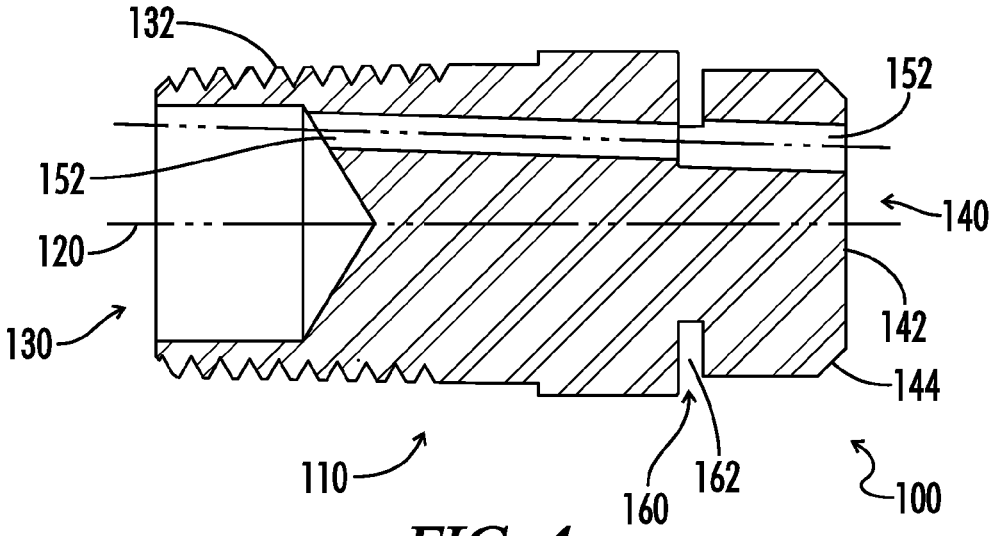
FIG. 4 is a cross-sectional view taken along line 4-4 of FIG. 2.
Figure 5:
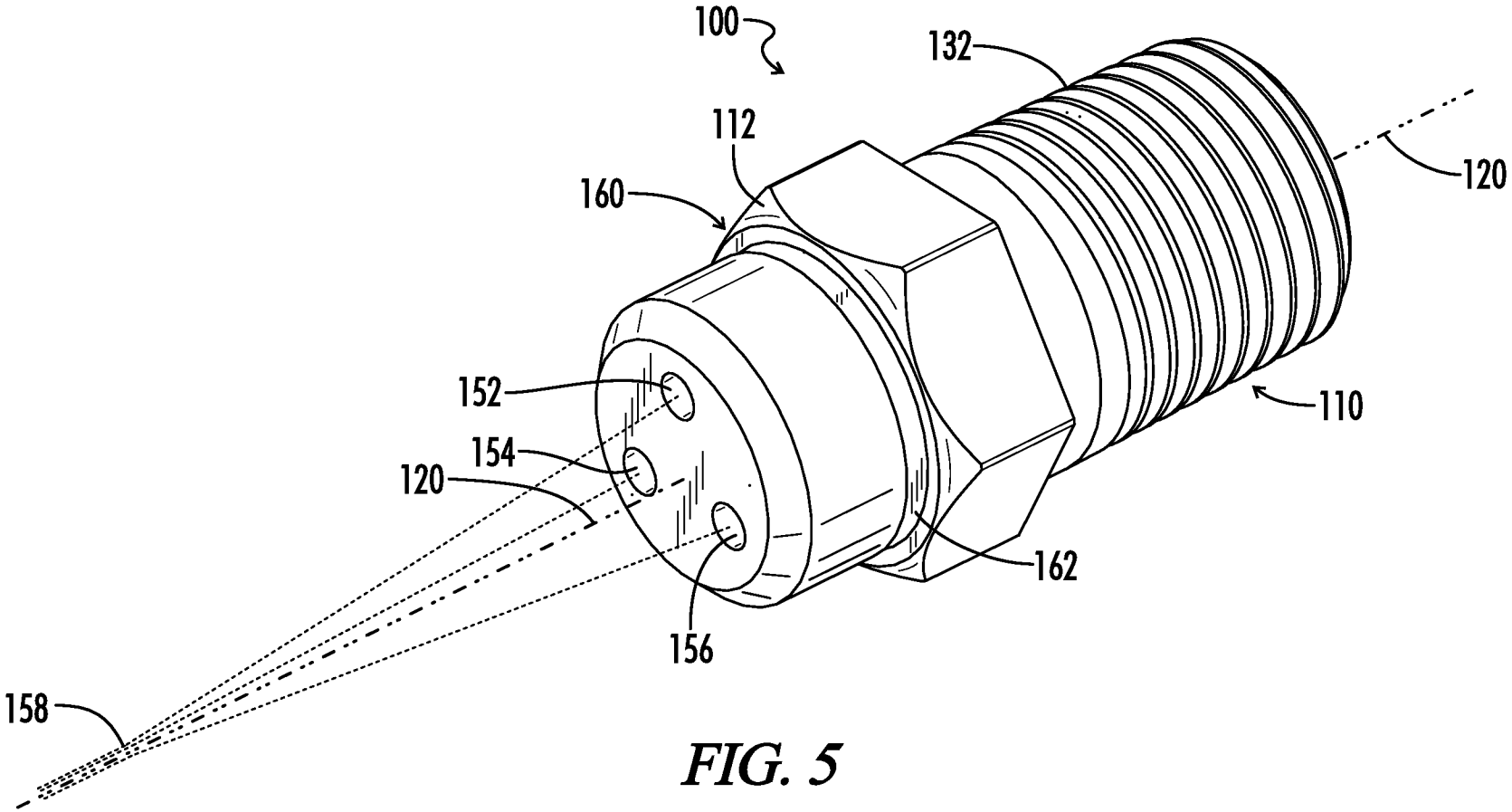
FIG. 5 shows one embodiment of the use of the nozzle tip of FIG. 1.
Figure 6:
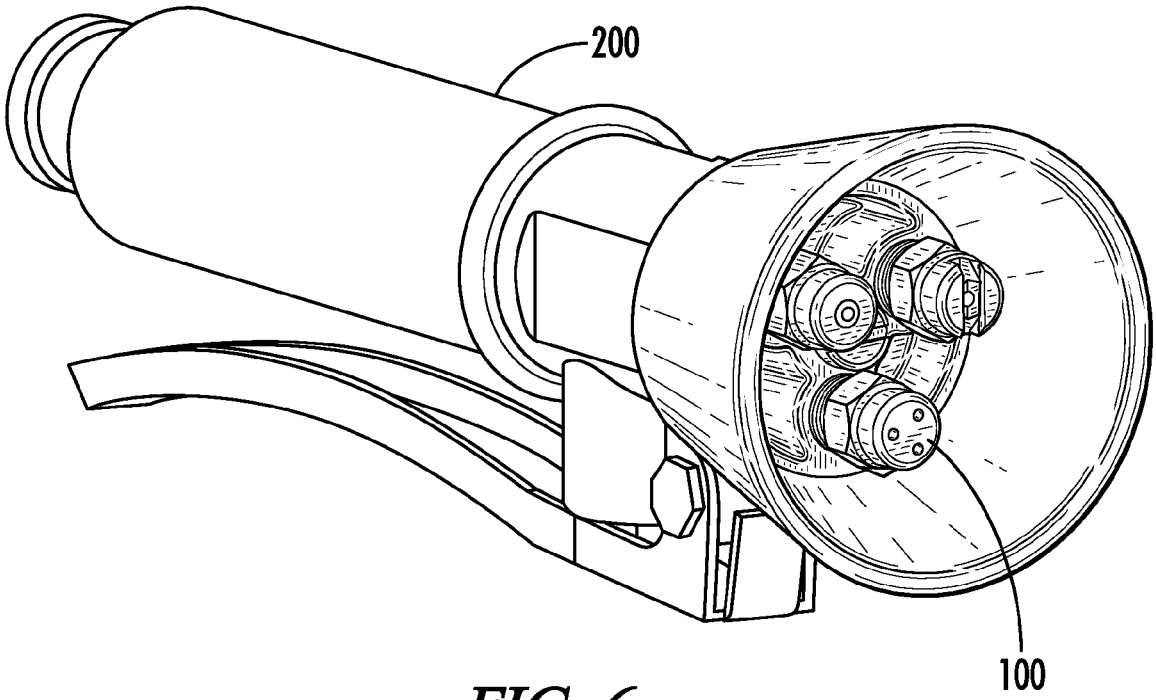
FIG. 6 shows one embodiment of the nozzle tip of FIG. 1 incorporated into a delivery device.

FIG. 1 is a perspective view, FIG. 2 is a front view, FIG. 3 is a side view, FIG. 4 is a cross-sectional view taken along line 4-4 of FIG. 2, FIG. 5 shows one embodiment of a use of an aerating nozzle tip 100, and FIG. 6 shows one embodiment of the nozzle tip 100 incorporated into a delivery device 200 such as a wash down nozzle or the like which may include multiple tips of different outlet configurations. The embodiment of the aerating nozzle tip 100 comprises a housing 110 having a central axis 120 (FIGS. 2-5), an inlet 130, an outlet 140 having an outlet face 142, a plurality of passages 152, 154, 156 (generally described as passages 150) disposed around the central axis 120 between the inlet 130 and the outlet face 142 of the outlet 140, and a circumferential ring-like aspirator 160 disposed between the inlet 130 and the outlet 140. As shown in FIG. 3, the plurality of passages 150 gradually converges toward or in the direction of the central axis 120 from the inlet 130 to the outlet 140. While three passages 150 are shown, it will be appreciated that fewer or greater than three passages may be used.

In the disclosed embodiment, the nozzle tip 100 further comprises a threaded inlet 132 for attachment to a liquid delivery system 200 (FIG. 6). The nozzle tip 100 may be used in other delivery systems. In addition, the outlet face 142 further comprises an anti-drip, anti-drooling chamfered peripheral edge 144. In a preferred embodiment, the chamfered peripheral edge 144 further comprises an approximately 45° chamfer, although other chamfer angles are contemplated. This chamfered edge prevents dripping or drooling of liquid medium from the outlet face 142.

In the disclosed embodiment, the plurality of passages 150 are angled relative to the central axis 120 such that a pressurized liquid (not shown) delivered through the passages 150 at sixty pounds per square inch (PSI), for example, will converge in a cone shape at a point contact 158 (FIG. 5) at approximately nine inches from the outlet 140. The angular relationship of the passages 150 are preferably optimized for straight flow of a liquid or other medium through the passages 150, and for convergence of the liquid or other medium beyond the outlet 140 (see FIG. 5 for example). One possible optimized dimension for a housing 110 that is 0.88 inches long, for example, includes a passage that is 0.70 inches long from the inlet 130 to the outlet 140 and that is angled at approximately 120° relative to the central axis 120. In other words, the length of a passage 150 from the inlet 130 to the outlet 140 is approximately 80% of the length of the housing 110 defined along the central axis 120 of the housing 110. Other dimensions are contemplated.

The circumferential aspirator 160 is defined between the inlet 130 and outlet 140 and preferably defines a continuous, uninterrupted ring-like opening 162 around the housing 110. While a ring-like opening is disclosed, it will be appreciated that other structural configurations are contemplated as long as the aspirator functions to simultaneously introduce air or the like into the fluid passage streams. The continuous opening 162 intersects each passage 152, 154, 156 to aerate a liquid or other flowable medium flowing through the passages 152, 154, 156 by allowing air to be drawn into the liquid flow. A portion 112 of the housing 110 adjacent to the aspirator 160 is preferably chamfered with an approximate 45° chamfer, although other chamfer dimensions are operable.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. An aerating nozzle tip comprising a housing having a central axis, an inlet, an outlet, a plurality of passages disposed around the central axis between the inlet and the outlet, and a circumferential aspirator disposed between the inlet and the outlet, wherein each of the plurality of passages has one end that faces the inlet and another end that faces the outlet, and the circumferential aspirator intersects with each of the plurality of passages so as to create an opening to each of the plurality of passages, the opening being located between the two ends of the respective each of the plurality of passages.

2. The aerating nozzle tip of claim 1, wherein the plurality of passages converge toward the central axis from the inlet to the outlet.

3. The aerating nozzle tip of claim 2, further comprising three passages.

4. The aerating nozzle tip of claim 1, further comprising a threaded inlet.

5. The aerating nozzle tip of claim 1, wherein the plurality of passages terminate at an outlet face at the outlet of the nozzle.

6. The aerating nozzle tip of claim 5, wherein the outlet face further comprises an anti-drip, anti-drooling chamfered peripheral edge.

7. The aerating nozzle tip of claim 6, wherein the anti-drip, anti-drooling chamfered peripheral edge further comprises an approximately 45° chamfer.

8. The aerating nozzle tip of claim 1, wherein the plurality of passages are angled relative to the central axis such that a pressurized liquid delivered through the passages at sixty psi will converge at approximately nine inches from the outlet.

9. The aerating nozzle tip of claim 1, wherein the passages are angled for optimized straight flow of a liquid through the passages and for convergence of a liquid at the outlet.

10. The aerating nozzle tip of claim 1, wherein each passage is approximately 0.70 inches long.

11. The aerating nozzle tip of claim 1, wherein each passage is arranged approximately 120° around the central axis.

12. The aerating nozzle tip of claim 1, wherein the circumferential aspirator defines a continuous opening around the housing.

13. The aerating nozzle tip of claim 12, wherein the continuous opening intersects each passage of the plurality of passages to aerate a liquid or other flowable medium flowing through the passages by allowing air to be drawn into the liquid flow.

14. The aerating nozzle tip of claim 13, wherein a portion of the housing adjacent to the circumferential aspirator is chamfered.

15. The aerating nozzle tip of claim 14, wherein the portion of the housing adjacent to the circumferential aspirator is chamfered with an approximate 45° chamfer.

16. The aerating nozzle tip of claim 1, wherein a length of a passage from the inlet to the outlet is approximately eighty percent of the length of the housing defined along the central axis.

17. A delivery device having an aerating nozzle tip, the nozzle tip comprising a housing having a central axis, an inlet, an outlet, a plurality of converging passages disposed around the central axis between the inlet and the outlet, and a circumferential aspirator defining a continuous opening and disposed between the inlet and the outlet, wherein each of the plurality of converging passages has one end that faces the inlet and another end that faces the outlet, and the circumferential aspirator intersects with each of the plurality of converging passages so as to create an opening to each of the plurality of converging passages, the opening being located between the two ends of the respective each of the plurality of converging passages.

18. The delivery device of claim 17, wherein the outlet face further comprises an anti-drip, anti-drooling chamfered peripheral edge.

19. The delivery device of claim 17, wherein the passages are angled for optimized straight flow of a liquid through the passages and for convergence of a liquid at the outlet.

20. The delivery device of claim 17, wherein each passage is arranged approximately 120° around the central axis.

* * * * *